US012025117B2

(12) United States Patent
Imai

(10) Patent No.: US 12,025,117 B2
(45) Date of Patent: Jul. 2, 2024

(54) TUBE HOLDING MEMBER AND TUBE PUMP

(71) Applicant: Surpass Industry Co., Ltd., Saitama (JP)

(72) Inventor: Hiroshi Imai, Saitama (JP)

(73) Assignee: Surpass Industry Co., Ltd., Saitama (JP)

( * ) Notice: Subject to any disclaimer, the term of this patent is extended or adjusted under 35 U.S.C. 154(b) by 404 days.

(21) Appl. No.: 17/325,771

(22) Filed: May 20, 2021

(65) Prior Publication Data

US 2021/0372393 A1 Dec. 2, 2021

(30) Foreign Application Priority Data

May 26, 2020 (JP) ..... 2020-091402

(51) Int. Cl.
*F04B 43/12* (2006.01)
*F04B 43/08* (2006.01)

(52) U.S. Cl.
CPC ..... *F04B 43/1253* (2013.01); *F04B 43/08* (2013.01)

(58) Field of Classification Search
CPC ..... F04B 43/009; F04B 43/0009; F04B 43/1253; F04B 43/1292; F04B 39/14; F04B 53/22; F04B 43/12; A61M 5/14232
USPC ..... 138/105, 106; 248/55; 417/477.2
See application file for complete search history.

(56) References Cited

U.S. PATENT DOCUMENTS 3,649,138 A 3/1972 Clay et al.
3,726,613 A 4/1973 Von Casimir
3,756,752 A 9/1973 Stenner
3,826,593 A 7/1974 Von Casimir
3,938,909 A 2/1976 Willock
3,985,019 A 10/1976 Boehme et al.
(Continued)

FOREIGN PATENT DOCUMENTS

DE 20109803 U1 10/2002
EP 1942964 A2 7/2008
(Continued)

OTHER PUBLICATIONS

European Search Report received in EP Application No. 21174877.7 entitled, "Tube Pump System," dated Sep. 24, 2021.
(Continued)

*Primary Examiner* — Philip E Stimpert
*Assistant Examiner* — Dnyanesh G Kasture
(74) *Attorney, Agent, or Firm* — Hamilton, Brook, Smith & Reynolds, P.C.

(57) ABSTRACT

Provided is a tube holding member including: an insertion portion that is inserted into an insertion groove that has a first width in a width direction; and a pair of arm portions that project from the insertion groove, in which the insertion portion includes a pair of wall portions that hold a tube in a pinched state, and a coupling portion that couples the pair of wall portions, the coupling portion is elastically deformable, and the pair of wall portions are disposed to be in contact with the insertion groove such that the pair of wall portions have a second width that is longer than the first width in the width direction in a state in which the insertion portion is not inserted into the insertion groove and have the first width in the width direction in a state in which the insertion portion is inserted into the insertion groove.

7 Claims, 10 Drawing Sheets

(56) References Cited

U.S. PATENT DOCUMENTS

| | | | | |
|---|---|---|---|---|
| 4,142,545 | A | 3/1979 | Lepp et al. | |
| 4,142,845 | A | 3/1979 | Lepp et al. | |
| 4,496,295 | A | 1/1985 | King | |
| 4,705,464 | A | 11/1987 | Arimond | |
| 5,388,972 | A | 2/1995 | Calhoun et al. | |
| 5,533,877 | A | 7/1996 | Freidmann et al. | |
| 5,586,872 | A | 12/1996 | Skobelev et al. | |
| 5,640,181 | A | 6/1997 | Uchida et al. | |
| 5,657,000 | A | 8/1997 | Ellingboe | |
| 5,971,726 | A | 10/1999 | Yoshida et al. | |
| 6,264,034 | B1 | 7/2001 | Yamazaki | |
| 6,264,634 | B1 | 7/2001 | Yamazaki | |
| 7,645,127 | B2 | 1/2010 | Hagen et al. | |
| 8,047,819 | B2 | 11/2011 | Lawrence et al. | |
| 10,082,136 | B2 | 9/2018 | Imai et al. | |
| 10,465,673 | B2 | 11/2019 | Ackermann et al. | |
| 10,528,064 | B2 | 1/2020 | Imai et al. | |
| 10,746,168 | B2 | 8/2020 | Imai et al. | |
| 11,542,937 | B2 | 1/2023 | Imai | |
| 2004/0057856 | A1 | 3/2004 | Saxer et al. | |
| 2004/0217236 | A1* | 11/2004 | Shibuya | F16L 3/13 248/68.1 |
| 2005/0019185 | A1 | 1/2005 | Otis, Jr. | |
| 2006/0245964 | A1 | 11/2006 | Koslov | |
| 2008/0213113 | A1* | 9/2008 | Lawrence | F04B 43/1253 417/477.2 |
| 2009/0053084 | A1 | 2/2009 | Klein | |
| 2011/0033318 | A1 | 2/2011 | Ramirez, Jr. et al. | |
| 2012/0195777 | A1 | 8/2012 | Stejskal et al. | |
| 2013/0072871 | A1 | 3/2013 | Ozturk | |
| 2013/0280104 | A1 | 10/2013 | Heide et al. | |
| 2013/0315763 | A1 | 11/2013 | Neoh et al. | |
| 2015/0159642 | A1 | 6/2015 | Sasa et al. | |
| 2015/0240802 | A1 | 8/2015 | Guthrie et al. | |
| 2015/0330385 | A1 | 11/2015 | Lofstrom et al. | |
| 2016/0245271 | A1 | 8/2016 | Schaefer et al. | |
| 2016/0265519 | A1 | 9/2016 | Igarashi | |
| 2017/0028117 | A1 | 2/2017 | Mochizuki | |
| 2017/0051735 | A1 | 2/2017 | Gaskill-Fox et al. | |
| 2017/0096995 | A1 | 4/2017 | Imai et al. | |
| 2018/0066646 | A1 | 3/2018 | Himmelmann | |
| 2018/0074525 | A1 | 3/2018 | Imai et al. | |
| 2018/0100605 | A1* | 4/2018 | Robinault | F16L 3/123 |
| 2018/0128266 | A1 | 5/2018 | Gaskill-Fox et al. | |
| 2018/0230987 | A1 | 8/2018 | Imai et al. | |
| 2019/0017500 | A1 | 1/2019 | Minatodani | |
| 2019/0120408 | A1* | 4/2019 | Milner | F16L 3/221 |
| 2019/0136853 | A1 | 5/2019 | Bach | |
| 2019/0234394 | A1 | 8/2019 | Gledhill, III et al. | |
| 2019/0285064 | A1 | 9/2019 | Imai et al. | |
| 2020/0038581 | A1* | 2/2020 | Bowman | G09F 3/18 |
| 2020/0208624 | A1 | 7/2020 | Wang et al. | |
| 2020/0263682 | A1 | 8/2020 | Imai | |
| 2021/0239108 | A1 | 8/2021 | Imai | |
| 2021/0372392 | A1 | 12/2021 | Imai | |
| 2021/0372393 | A1 | 12/2021 | Imai | |

FOREIGN PATENT DOCUMENTS

| | | | |
|---|---|---|---|
| EP | 2397695 | A1 | 12/2011 |
| EP | 3543532 | A1 | 9/2019 |
| JP | S52112805 | A | 9/1977 |
| JP | S56129790 | A | 10/1981 |
| JP | 57-026690 | U | 2/1982 |
| JP | S5773882 | A | 5/1982 |
| JP | 62-126585 | U | 8/1987 |
| JP | 04-080545 | U | 7/1992 |
| JP | 04-100086 | U | 8/1992 |
| JP | H05-263765 | A | 10/1993 |
| JP | 2000-205201 | A | 7/2000 |
| JP | 2003-021050 | A | 1/2003 |
| JP | 2008-002388 | A | 1/2008 |
| JP | 2008308994 | A | 12/2008 |
| JP | 2013-240135 | A | 11/2013 |
| JP | 2013231413 | A | 11/2013 |
| JP | 2014214614 | A | 11/2014 |
| JP | 2016169620 | A | 9/2016 |
| JP | 2017062247 | A | 3/2017 |
| JP | 2017067054 | A | 4/2017 |
| JP | 2018044488 | A | 3/2018 |
| JP | 2018-131946 | A | 8/2018 |
| WO | 2007/038364 | A2 | 4/2007 |

OTHER PUBLICATIONS

European Search Report received in EP Application No. 21175039.3 entitled, "Tube Holding Member and Tube Pump," dated Nov. 25, 2021.

European Extended Search Report dated Nov. 27, 2017 for European Application No. 17190606.8-1616, entitled "Tube Pump System and Method for Controlling the Tube Pump System.".

European Search Report for European Application No. 19162820.5, entitled Tube Pump System and Method for Controlling the Tube Pump System, dated Jul. 15, 2019.

Extended European Search Report for Application No. 21055305.4, entitled: Tube Pump System and Method for Controlling the Tube Pump System, dated May 8, 2020.

U.S. Non-Final Office Action for U.S. Appl. No. 16/295,319, entitled Tube Pump System and Method for Controlling the Tube Pump System, dated Sep. 11, 2020.

* cited by examiner

TUBE HOLDING MEMBER AND TUBE PUMP

RELATED APPLICATION(S)

This application claims priority under 35 U.S.C. § 119 or 365 to Japanese Application No. 2020-091402, filed on May 26, 2020. The entire teachings of the above application(s) are incorporated herein by reference.

TECHNICAL FIELD

The present disclosure relates to a tube holding member and a tube pump.

DESCRIPTION OF RELATED ART

In the related art, a tube pump that pressure-transfers a liquid in a tube by intermittently squashing a tube with flexibility with a plurality of rollers is known (see Japanese Unexamined Patent Application, Publication No. 2018-131946, for example). The tube pump disclosed in Japanese Unexamined Patent Application, Publication No. 2018-131946 is adapted to cause a liquid in a tube to be ejected on a flow-out side by causing a roller portion to rotate about an axial line in a state in which a flexible tube is squashed.

In Japanese Unexamined Patent Application, Publication No. 2018-131946, a pair of tube pushing rings are attached to the tube in order to hold the position of the tube even in a case in which an external force caused by contact with the roller portion works.

In Japanese Unexamined Patent Application, Publication No. 2018-131946, the position of the tube is fixed relative to a tube case by accommodating the pair of tube pushing rings in a pair of fixing holes formed in the tube case.

The tube pump disclosed in Japanese Unexamined Patent Application, Publication No. 2018-131946 is adapted such that an attachment mechanism performs switching between an attached state in which a holding mechanism that holds the tube is attached to a drive mechanism that drives the roller portion and a separated state in which the holding mechanism is separated from the drive mechanism. In the separated state in which the holding mechanism is separated from the drive mechanism, there is a probability that the tube pushing rings come off from the fixing holes of the tube case. Also, if the tube pushing rings are formed into a shape with substantially the same size as that of the fixing holes, and the tube pushing rings are pressure-fitted into the fixing holes of the tube case to prevent the tube pushing rings from coming off from the fixing holes, it becomes difficult to detach the tube pushing rings from the fixing holes.

The present disclosure was made in view of such circumstances, and an object thereof is to provide a tube holding member capable of reliably maintaining a state in which a tube is held in an insertion groove and facilitating an operation of detaching the tube from the insertion groove and a tube pump including the tube holding member.

BRIEF SUMMARY

The present disclosure employs the following means to solve the aforementioned problem.

A tube holding member according to an aspect of the present disclosure is a tube holding member inserted into an insertion groove that extends along an axial direction and has a first width in a width direction that perpendicularly intersects the axial direction and holding a tube in the insertion groove along the axial direction, the tube holding member including: an insertion portion that is inserted into the insertion groove in a state in which the tube is fixed along the axial direction; and a pair of arm portions that extend along the axial direction and project from the insertion groove in a state in which the insertion portion is inserted up to a bottom portion of the insertion groove, in which the insertion portion includes a pair of wall portions that extend along the axial direction, are coupled to the pair of arm portions, and are disposed at an interval in the width direction such that the pair of wall portions hold the tube in a pinched state, and a coupling portion that extends along the axial direction, couples the pair of wall portions, and is disposed to face the bottom portion of the insertion groove, the coupling portion is elastically deformable along the width direction, and the pair of wall portions are disposed to be in contact with the insertion groove such that the pair of wall portions have a second width that is longer than the first width in the width direction in a state in which the insertion portion is not inserted into the insertion groove and have the first width in the width direction in a state in which the insertion portion is inserted into the insertion groove.

According to the tube holding member in the aspect of the present disclosure, the pair of wall portions included in the insertion portion have the second width that is longer than the first width of the insertion groove in the width direction in the state in which the insertion portion is not inserted into the insertion groove. An operator pinches, with finger tips, the pair of arm portions coupled to the pair of wall portions that hold the tube in the pinched state and applies an external force in a direction of narrowing the interval between the pair of wall portions in the width direction. Then, the coupling portion is elastically deformed, and the length between the pair of wall portions in the width direction becomes shorter than the first width of the insertion groove. The operator can insert the insertion portion up to the bottom portion of the insertion groove by maintaining the state in which the length between the pair of wall portions in the width direction is shorter than the first width.

If the operator releases the state in which the operator pinches the pair of arm portions with the finger tips, a part of the elastic deformation of the coupling portion is released, the length between the pair of wall portions in the width direction is widened up to the first width of the insertion groove, and each of the pair of wall portions comes into contact with the insertion groove. Since a part of the elastic deformation of the coupling portion is held without being released, the insertion portion is held in the insertion groove due to an elastic force of the coupling portion. It is thus possible to reliably maintain the state in which the tube is held in the insertion groove by the tube holding member.

Also, when the tube is to be detached from the insertion groove, the operator pinches, with finger tips, the pair of arm portions of the insertion portion of the tube holding member held in the insertion groove. If the operator applies an external force in a direction of narrowing the interval between the pair of wall portions in the width direction, then the coupling portion is elastically deformed, and the length between the pair of wall portions in the width direction becomes shorter than the first width of the insertion groove. The operator can easily pull out the insertion portion from the insertion groove by maintaining the state in which the length between the pair of wall portions in the width direction is shorter than the first width. It is thus possible to easily perform the operation of detaching the tube from the insertion groove by the tube holding member.

The tube holding member according to the aspect of the present disclosure is preferably configured such that the insertion portion and the pair of arm portions are integrally molded using a resin material.

It is possible to cause the entire tube holding member including the coupling portion to be appropriately elastically deformed due to an external force applied by the operator and to hold the insertion portion in the insertion groove, by integrally molding the insertion portion and the pair of arm portions using the resin material.

The tube holding member according to the aspect of the present disclosure is preferably configured such that projecting portions projecting toward the tube and extending in a direction that perpendicularly intersects the axial direction are formed in surfaces of the pair of wall portions that come into contact with the tube.

According to the tube holding member with this configuration, the projecting portions extending in the direction that perpendicularly intersects the axial direction are formed in the surfaces of the pair of wall portions that come into contact with the tube. Since the projecting portion is caused to strongly abut on the outer circumferential surface of the tube, it is possible to hold the tube held in a state in which the tube is pinched between the pair of wall portions to prevent the tube from moving in the axial direction.

The tube holding member according to the aspect of the present disclosure is preferably configured such that display portions that display identification information for identifying the tube to be held by the pair of wall portions are provided at distal end portions of the arm portions.

According to the tube holding member with the configuration, since the display portions that display the identification information for identifying the tube are provided at the distal end portions of the arm portions projecting from the insertion groove, it is possible for the operator to easily identify the tube to be held in the insertion groove.

The tube holding member according to the aspect of the present disclosure is preferably configured such that the distal end portions of the pair of arm portions are formed into shapes projecting outward in the width direction.

According to the tube holding member with the configuration, since the distal ends of the pair of arm portions project outward in the width direction, it is possible for the operator to easily perform the operation of pinching the pair of arm portions with finger tips and applying an external force in the direction of narrowing the interval between the pair of wall portions in the width direction.

A tube pump according to an aspect of the present disclosure includes: an accommodating portion that has an inner circumferential surface, which is formed into an arc shape around a rotational axis, on which a tube with flexibility is disposed, and is opened to one end side along the rotational axis; a plurality of roller portions that are accommodated in the accommodating portion and rotate about the rotational axis in a state in which the tube is blocked; and a drive unit that causes the plurality of roller portions to rotate about the rotational axis, an insertion groove that extends along an axial direction and has a first width in a width direction that perpendicularly intersects the axial direction is formed in the accommodating portion, a tube holding member that holds the tube in the insertion groove along the axial direction is included, the tube holding member includes an insertion portion that is inserted into the insertion groove in a state in which the tube is disposed along the axial direction, and a pair of arm portions that extend along the axial direction and project from the insertion groove in a state in which the insertion portion is inserted up to a bottom portion of the insertion groove, the insertion portion includes a pair of wall portions that extend along the axial direction, are coupled to the pair of arm portions, and are disposed at an interval in the width direction such that the pair of wall portions hold the tube in a pinched state, and a coupling portion that extends along the axial direction, couples the pair of wall portions, and is disposed to face the bottom portion of the insertion groove, the coupling portion is elastically deformable along the width direction, and the pair of wall portions are disposed to be in contact with the insertion groove such that the pair of wall portions have a second width that is longer than the first width in the width direction in a state in which the insertion portion is not inserted into the insertion groove and have the first width in the width direction in a state in which the insertion portion is inserted into the insertion groove.

According to the tube pump in the aspect of the present disclosure, it is possible to reliably maintain the state in which the tube is held in the insertion groove by the tube holding member and to facilitate an operation of detaching the tube from the insertion groove.

The tube pump according to the aspect of the present disclosure is preferably configured such that the accommodating portion has a recessed portion that accommodates the plurality of roller portions, a lid portion that is able to be switched between a closed state in which the lid portion covers an entire region of the recessed portion and an opened state in which the lid portion is separated from the recessed portion is included, display portions that display identification information for identifying the tube to be held by the pair of wall portions are provided at distal end portions of the arm portions in the tube holding member, and a pair of through-holes that accommodate the pair of arm portions in the closed state are formed in the lid portion.

According to the tube pump with the configuration, the pair of arm portions of the tube holding member and the pair of through-holes that accommodate the arm portions in the closed state are formed in the lid portion. It is thus possible for the operator to easily recognize the identification information for identifying the tube that is displayed at the display portions provided at the distal end portions of the arm portions in the closed state.

According to the present disclosure, it is possible to provide a tube holding member capable of reliably maintaining a state in which a tube is held in an insertion groove and facilitating an operation of detaching the tube from the insertion groove and a tube pump including the tube holding member.

DETAILED DESCRIPTION

Figure 1:
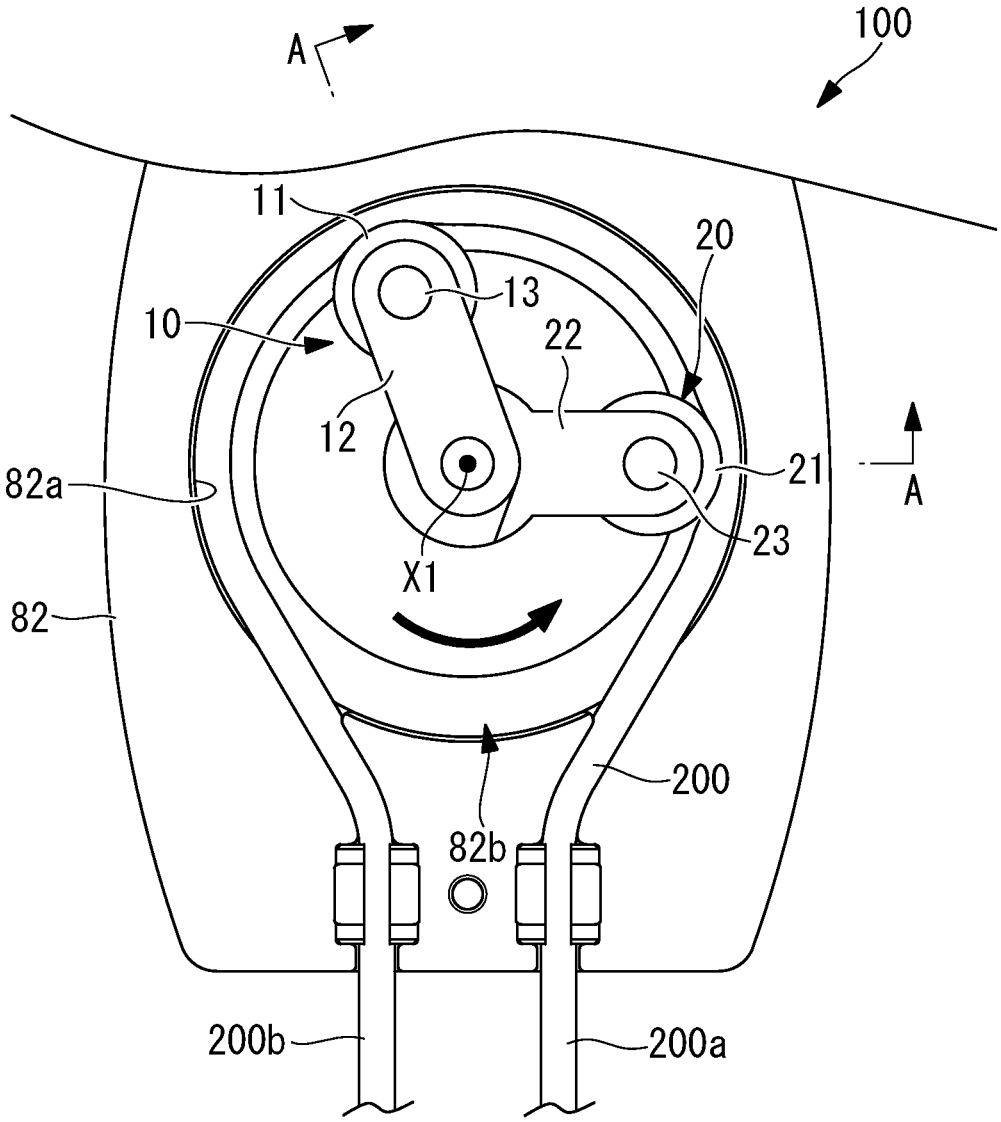
FIG. 1 is a plan view illustrating an embodiment of a tube pump.
Figure 2:
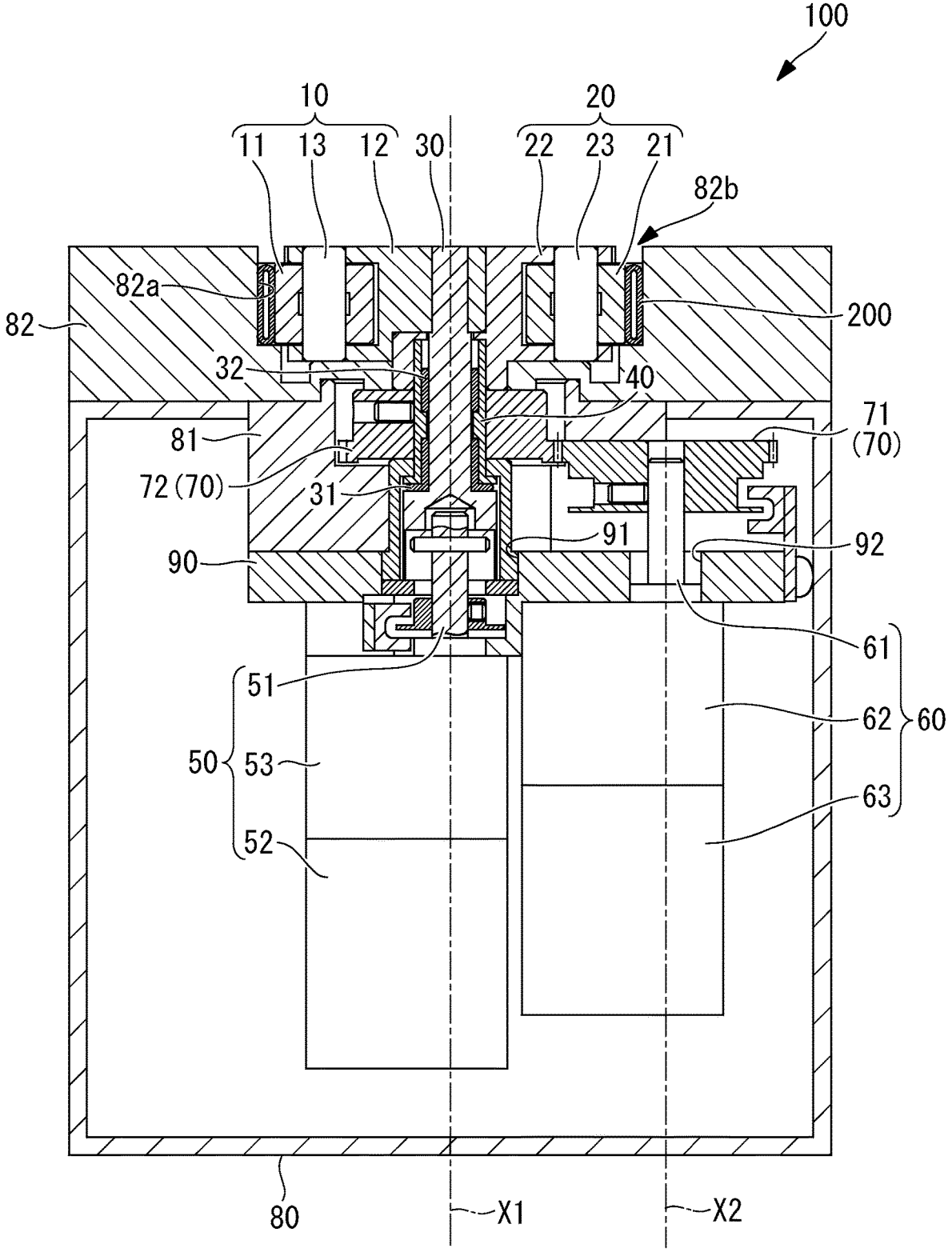
FIG. 2 is a vertical sectional view of the arrows A-A of the tube pump illustrated in FIG. 1.

Hereinafter, a tube pump 100 according to an embodiment of the present disclosure will be described with reference to drawings. FIG. 1 is a plan view illustrating an embodiment of the tube pump 100. FIG. 2 is a vertical sectional view of the arrows A-A of the tube pump 100 illustrated in FIG. 1.

The tube pump 100 according to the present embodiment illustrated in FIG. 1 is a device that causes a liquid in a tube 200 flowing from a flow-in side 200*a* to be ejected to a flow-out side 200*b* by causing a first roller portion 10 and a second roller portion 20 to rotate about an axial line X1 (rotational axis) in the same direction (the direction illustrated by the arrow in FIG. 1).

As illustrated in the plan view in FIG. 1, the tube 200 is disposed in the tube pump 100 in an arc shape around the axial line X1 along an inner circumferential surface 82*a* of an accommodating portion 82 that accommodates the first roller portion 10 and the second roller portion 20. The inner circumferential surface 82*a* is a surface, which is formed into an arc shape around the axial line X1, on which the tube 200 is disposed. The accommodating portion 82 includes a recessed portion 82*b* that is opened toward one end side along the axial line X1 and accommodates the first roller portion 10 and the second roller portion 20.

As illustrated in FIG. 1, the first roller portion 10 and the second roller portion 20 accommodated in the accommodating portion 82 rotate about the axial line X1 along a counterclockwise rotational direction (the direction illustrated by the arrow in FIG. 1) while being in contact with the tube 200.

As illustrated in FIG. 2, the tube pump 100 according to the present embodiment includes the first roller portion 10 and the second roller portion 20 that rotate about the axial line X1 in a state in which the tube 200 is blocked, a drive shaft 30 that is disposed on the axial line X1 and is coupled to the first roller portion 10, a drive cylinder 40 that is coupled to the second roller portion 20, a first drive unit 50 that transmits a drive force to the drive shaft 30, a second drive unit 60, and a transmission mechanism 70 that transmits a drive force of the second drive unit 60 to the drive cylinder 40.

The first roller portion 10 includes a first roller 11 that rotates about an axial line that is parallel to the axial line X1 while being in contact with the tube 200, a first roller support member 12 that is coupled to the drive shaft 30 such that the first roller support member 12 integrally rotates about the axial line X1, and a first roller shaft 13, which has both end portions supported by the first roller support member 12, to which the first roller 11 is rotatably attached.

The first drive unit 50 causes the first roller portion 10 to rotate about the axial line X1 in the counterclockwise rotational direction. The first roller support member 12 is coupled to the first drive unit 50 and rotates about the axial line in the counterclockwise direction while supporting the first roller 11.

The second roller portion 20 includes a second roller 21 that rotates about the axial line that is parallel to the axial line X1 while being in contact with the tube 200, a second roller support member 22 that is coupled to the drive cylinder 40 such that the second roller support member 22 integrally rotates about the axial line X1, and a second roller shaft 23, which has both end portions supported by the second roller support member 22, to which the second roller 21 is rotatably attached.

The second drive unit 60 causes the second roller portion 20 to rotate about the axial line X1 in the counterclockwise rotational direction. The second roller support member 22 is coupled to the second drive unit 60 and rotates about the axial line in the counterclockwise direction while supporting the second roller 21.

As illustrated in FIG. 2, the first drive unit 50 and the second drive unit 60 are accommodated inside a casing 80 (accommodating member). A gear accommodating portion 81 for accommodating the transmission mechanism 70 and a support member 90 that supports the first drive unit 50 and the second drive unit 60 are attached to the inside of the casing 80. Also, the accommodating portion 82 for accommodating the first roller portion 10 and the second roller portion 20 is attached to the upper portion of the casing 80.

A first through-hole 91 extending along the axial line X1 and a second through-hole 92 extending along an axial line X2 are formed in the support member 90. The first drive unit 50 is attached to the support member 90 with a fastening bolt (not illustrated) in a state in which a first drive shaft 51 is inserted into the first through-hole 91 formed in the support member 90. Similarly, the second drive unit 60 is attached to the support member 90 with a fastening bolt (not illustrated) in a state in which a second drive shaft 61 is inserted into the second through-hole 92 formed in the support member 90. In this manner, each of the first drive unit 50 and the second drive unit 60 is attached to the support member 90 that is an integrally formed member.

The first drive unit 50 includes the first drive shaft 51, a first electric motor 52, and a first decelerator 53 that decelerates rotation of a rotational shaft (not illustrated) caused to rotate by the first electric motor 52 and transmits the decelerated rotation to the first drive shaft 51. The first drive unit 50 causes the first drive shaft 51 to rotate about the axial line X1 by transmitting a drive force of the first electric motor 52 to the first drive shaft 51.

The drive shaft 30 has a lower end coupled to the first drive shaft 51. The drive shaft 30 is supported on the inner circumferential side of the drive cylinder 40 by a cylindrical first bearing member 31 inserted along an outer circumferential surface and a cylindrical second bearing member 32 that is formed independently from the first bearing member 31 such that the drive shaft 30 is rotatable about the axial line X1. In this manner, the drive shaft 30 has an outer circumferential surface on the lower end side supported by the first bearing member 31 and an outer circumferential surface at the center portion supported by the second bearing member 32. Therefore, the drive shaft 30 smoothly rotates about the axial line X1 in a state in which the central axis thereof is held on the axial line X1.

The first roller support member 12 of the first roller portion 10 is coupled to the drive shaft 30 on the distal end side such that the first roller support member 12 integrally rotates about the axial line X1. As described above, the drive force of the first drive unit 50 causing the first drive shaft 51 to rotate about the axial line X1 is transmitted from the first drive shaft 51 to the first roller portion 10 via the drive shaft 30.

The transmission mechanism 70 includes a first gear portion 71 that rotates about the axial line X2 (second axial line) that is parallel to the axial line X1 and a second gear portion 72 to which a drive force of the second drive shaft 61 is transmitted from the first gear portion 71. The transmission mechanism 70 transmits the drive force of the second drive shaft 61 around the axial line X2 to the outer circumferential surface of the drive cylinder 40 and causes the drive cylinder 40 to rotate about the axial line X1.

The second drive unit 60 includes the second drive shaft 61 that is disposed on the axial line X2, a second electric motor 62, and a second decelerator 63 that decelerates rotation of a rotational shaft (not illustrated) caused to rotate by the second electric motor 62 and transmits the decelerated rotation to the second drive shaft 61. The second drive unit 60 causes the second drive shaft 61 to rotate about the axial line X2 by transmitting a drive force of the second electric motor 62 to the second drive shaft 61.

The drive cylinder 40 is inserted into an insertion hole formed at the center portion of the second gear portion 72 that is formed into a cylindrical shape around the axial line X1. The insertion hole is a hole with an inner circumferential surface that is coupled to the outer circumferential surface of the drive cylinder 40. The second gear portion 72 is secured to the drive cylinder 40 by fastening a securing screw (not illustrated) in a state in which the drive cylinder 40 is inserted and causing the distal end of the securing screw to abut on the drive cylinder 40. In this manner, the second gear portion 72 is coupled to the drive cylinder 40 and rotates about the axial line X1 along with the drive cylinder 40.

The drive cylinder 40 is disposed in a state in which the first bearing member 31 and the second bearing member 32 are interposed on the outer circumferential side of the drive shaft 30. Therefore, the drive cylinder 40 is rotatable about the axial line X1 independently from the drive shaft 30. The drive shaft 30 rotates about the axial line X1 due to the drive force of the first drive unit 50, and the drive cylinder 40 rotates about the axial line X1 due to the drive force of the second drive unit 60 in an independent state from the drive shaft 30.

The second roller support member 22 of the second roller portion 20 is coupled to the drive cylinder 40 on the distal end side such that the second roller support member 22 integrally rotates about the axial line X1. As described above, the drive force of the second drive unit 60 causing the second drive shaft 61 to rotate about the axial line X2 is transmitted to the outer circumferential surface of the drive cylinder 40 by the transmission mechanism 70 and is transmitted from the drive cylinder 40 to the second roller portion 20.

Figure 3:
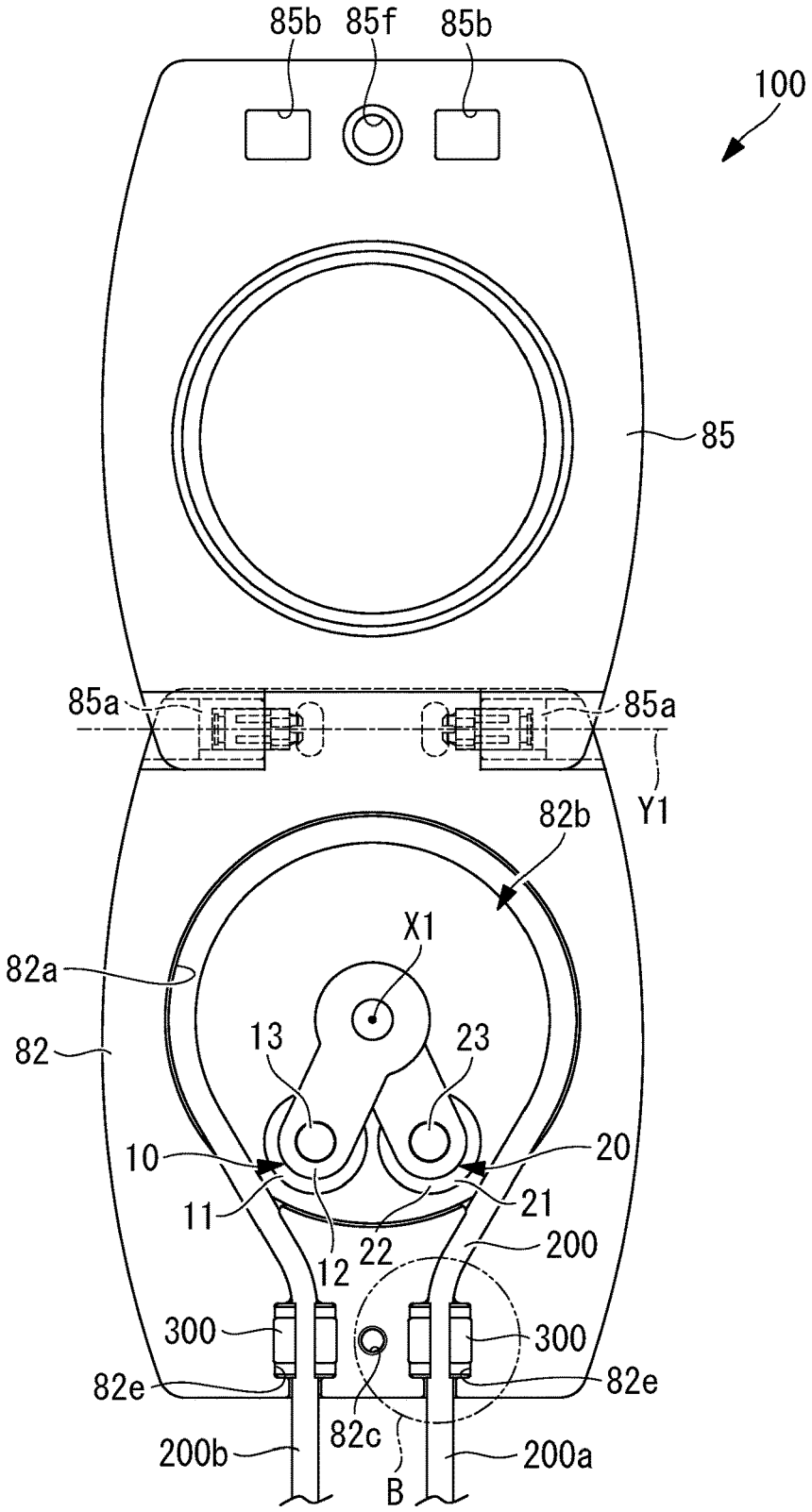
FIG. 3 is a plan view illustrating an embodiment of the tube pump with a lid portion in an opened state.

Next, a tube holding member 300 included in the tube pump 100 according to the present embodiment will be described with reference to the drawings. FIG. 3 is a plan view illustrating an embodiment of the tube pump 100 with a lid portion 85 in an opened state.

Figure 4:
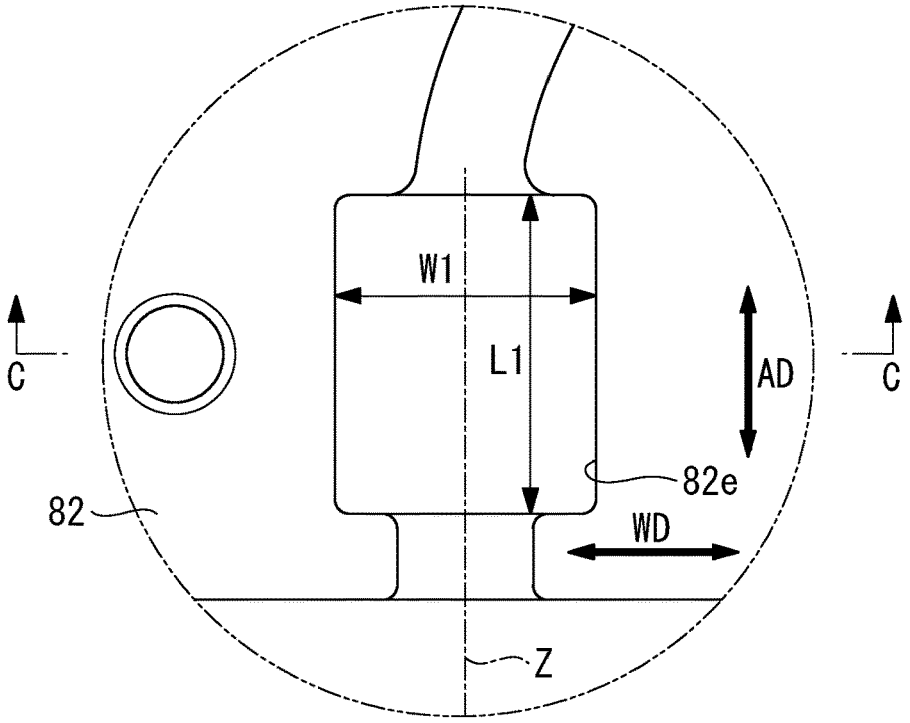
FIG. 4 is a partially enlarged view of the portion B illustrated in FIG. 3 and is a diagram illustrating a state in which a tube and a tube holding member have not been attached to an accommodating portion.
Figure 5:
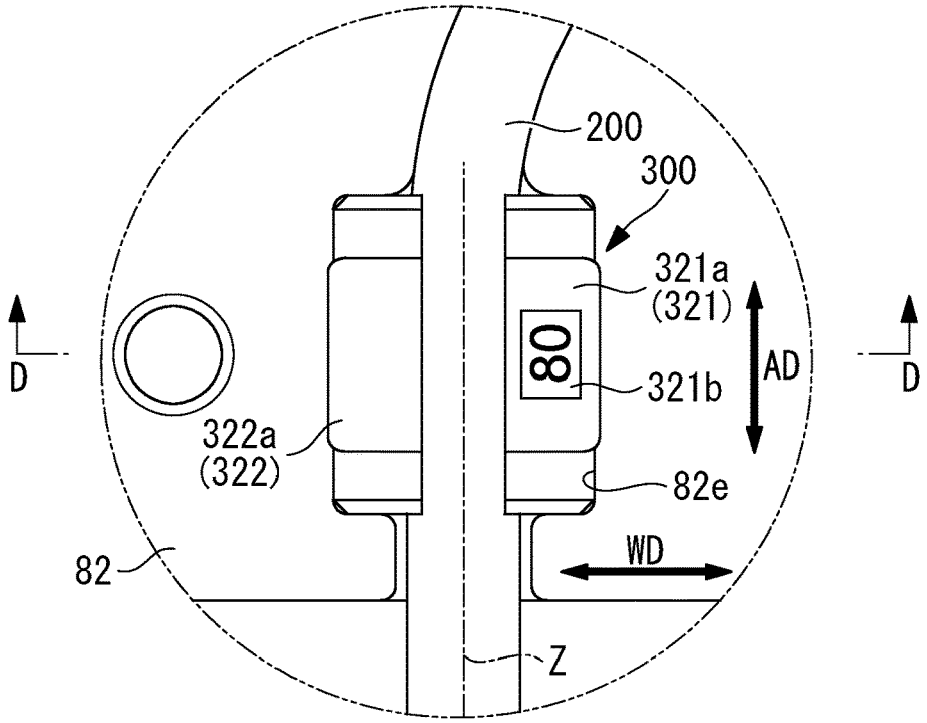
FIG. 5 is a partially enlarged view of the portion B illustrated in FIG. 3 and is a view illustrating a state in which the tube and the tube holding member have been attached to the accommodating portion.
Figure 6:
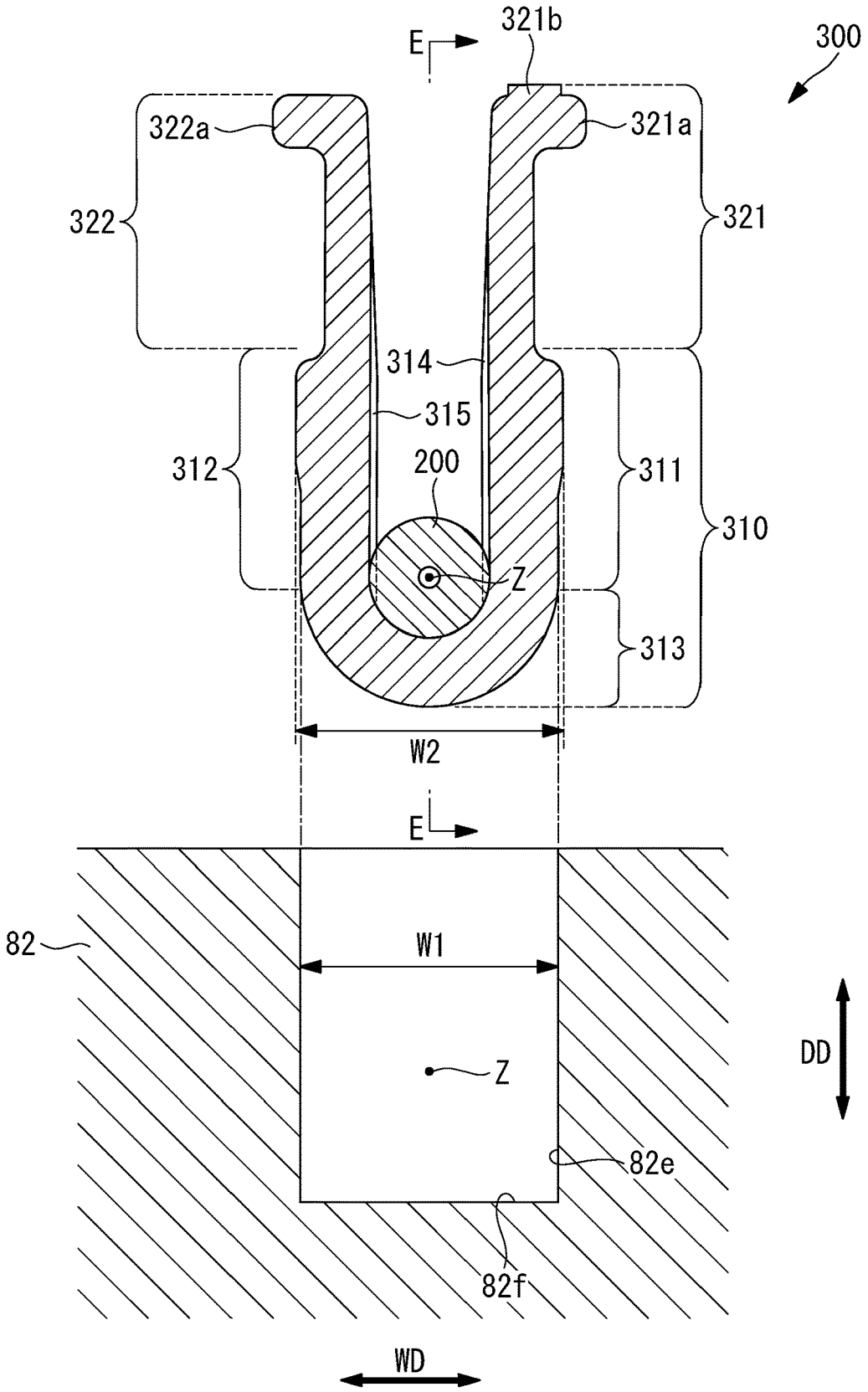
FIG. 6 is a sectional view of the arrows C-C in FIG. 4.
Figure 7:
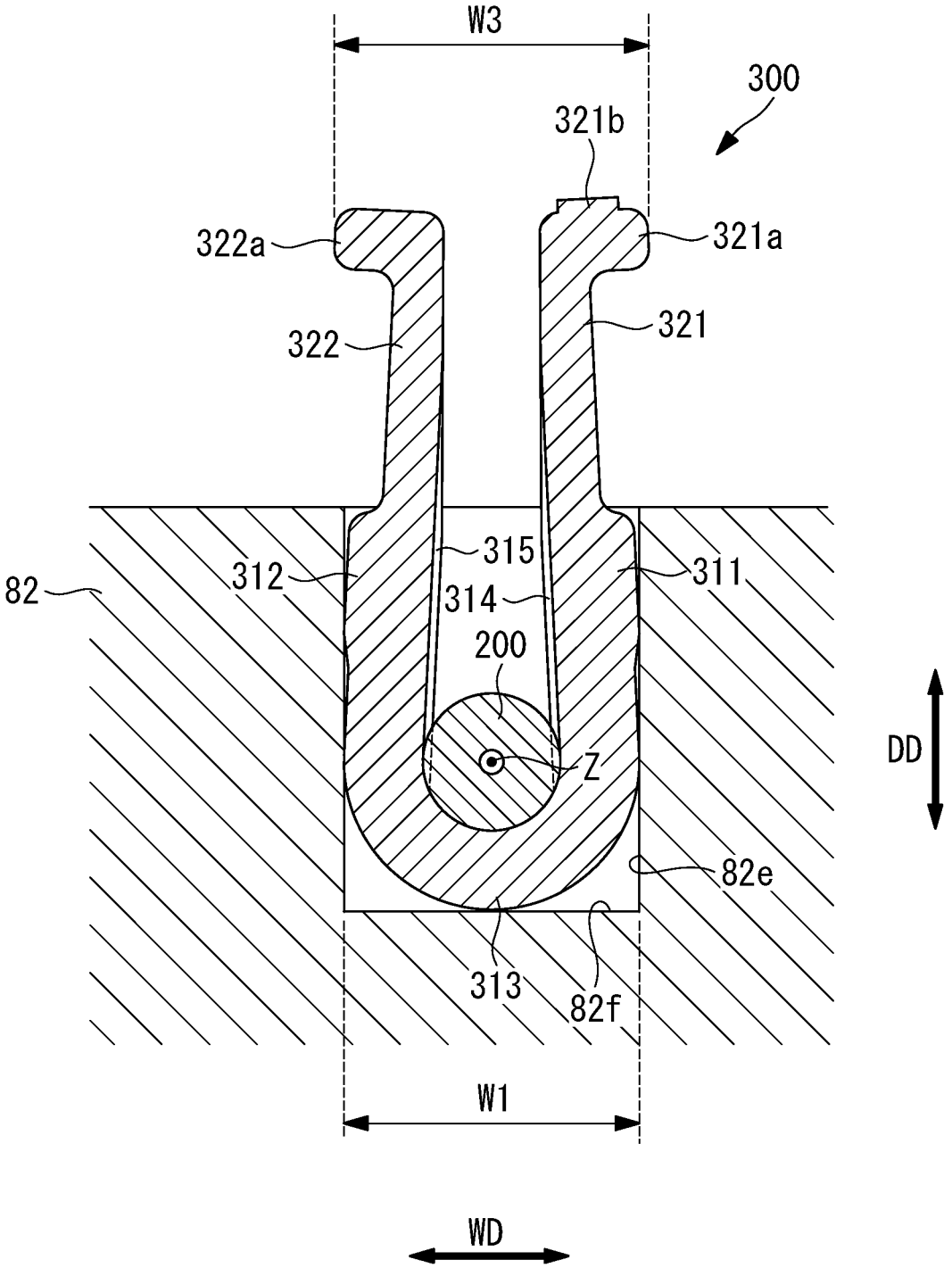
FIG. 7 is a sectional view of the arrows D-D in FIG. 5.
Figure 8:
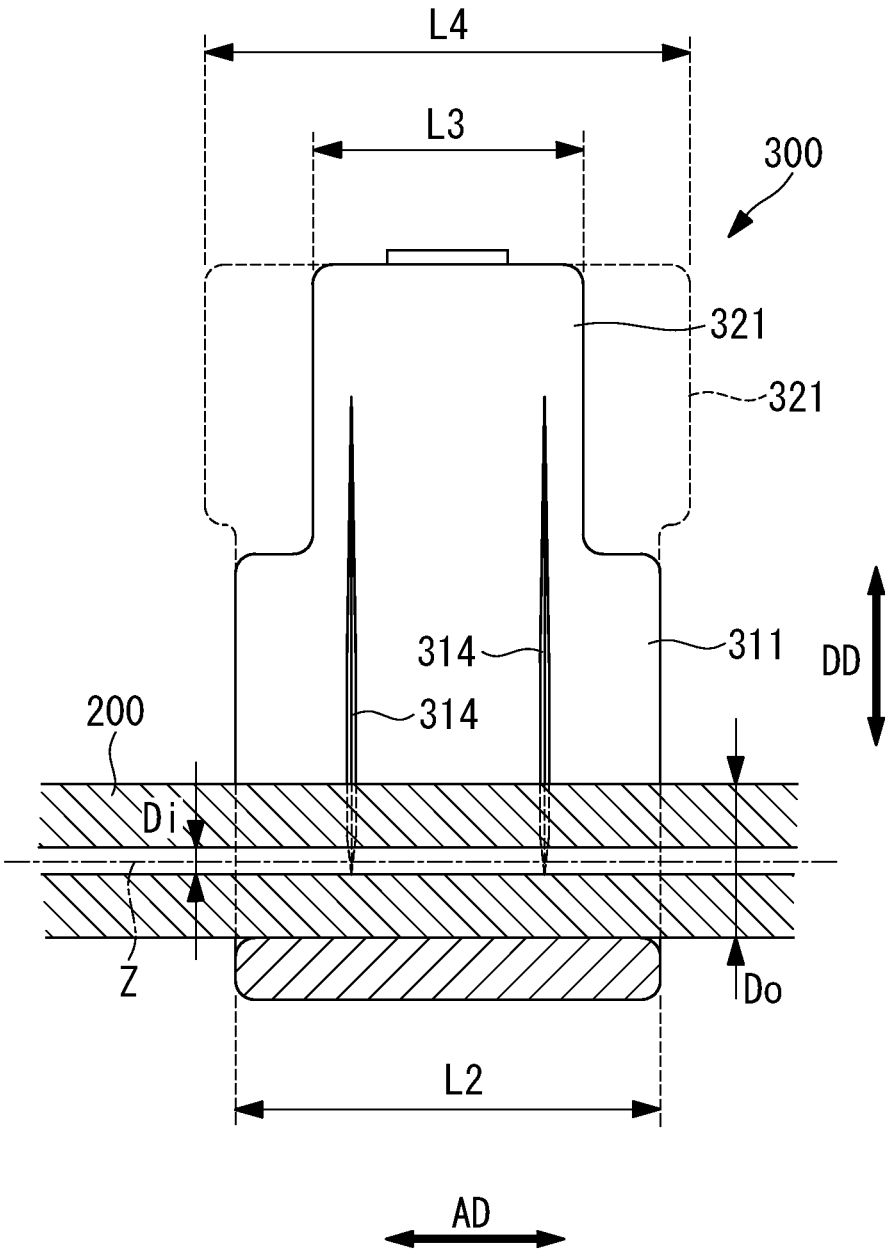
FIG. 8 is a sectional view of the arrows E-E in FIG. 6.

FIG. 4 is a partially enlarged view of the portion B illustrated in FIG. 3 and is a diagram illustrating a state in which the tube 200 and the tube holding member 300 have not been attached to the accommodating portion 82. FIG. 5 is a partially enlarged view of the portion B illustrated in FIG. 3 and is a diagram illustrating a state in which the tube 200 and the tube holding member 300 have been attached to the accommodating portion. FIG. 6 is a sectional view of the arrows C-C in FIG. 4. FIG. 7 is a sectional view of the arrows D-D in FIG. 5. FIG. 8 is a sectional view of the arrows E-E in FIG. 6.

As illustrated in FIG. 3, the first tube pump 100 according to the present embodiment includes the first tube holding members 300 and the lid portion 85 that can be switched between opened and closed states by swinging around an axial line Y1. The first tube pump 100 illustrated in FIG. 3 is illustrated in a retreating state in which the rotational angle of the first roller portion 10 and the second roller portion 20 around the axial line X1 is fixed and both the first roller portion 10 and the second roller portion 20 are not in contact with the first tube 200.

The tube holding members 300 are members that are inserted into a insertion groove 82*e* formed in the accommodating portion 82 and hold the tube 200 in the insertion groove 82*e* along an axial direction AD. As illustrated in FIGS. 4 and 6, the insertion groove 82*e* is a groove that is formed in the accommodating portion 82 and extends along the axial direction AD that is a direction in which an axial line Z extends. The insertion groove 82*e* has a first width W1 in a width direction WD that perpendicularly intersects the axial direction AD. As illustrated in FIG. 6, the first width W1 of the insertion groove 82*e* is the same width at each location in a depth direction DD in which the tube holding members 300 are inserted into the insertion groove 82*e*.

As illustrated in FIGS. 6 and 7, each tube holding member 300 includes an insertion portion 310, an arm portion 321, and an arm portion 322. The insertion portion 310, the arm portion 321, and the arm portion 322 are integrally molded using an elastically deformable resin material with flexibility (polycarbonate, for example).

The insertion portion 310 is inserted into the insertion groove 82*e* in a state in which the tube 200 is disposed along the axial direction AD. The arm portion 321 and the arm portion 322 are portions that extend along the axial direction AD and project from the insertion groove 82*e* in a state in which the insertion portion 310 is inserted up to a bottom portion 82*f* of the insertion groove 82*e*.

The insertion portion 310 includes a wall portion 311, a wall portion 312, and a coupling portion 313. The wall portion 311 is a member that extends along the axial direction AD and is coupled to the arm portion 321. The wall portion 312 is a member that extends along the axial direction AD and is coupled to the arm portion 322. The wall portion 311 and the wall portion 312 are disposed at an interval in the width direction WD to hold the tube 200 therebetween in a pinched state.

The coupling portion 313 is a member that extends along the axial direction AD and couples the wall portion 311 and the wall portion 312. As illustrated in FIG. 7, the coupling portion 313 is disposed to face the bottom portion 82*f* of the insertion groove 82*e* in a state in which the insertion portion 310 is inserted into the insertion groove 82*e*. Since the coupling portion 313 is formed using a resin material, the coupling portion 313 is a member that is elastically deformable to contract along the width direction WD by the operator pinching the arm portion 321 and the arm portion 322 with finger tips and narrowing the interval therebetween in the width direction WD.

As illustrated in FIG. 6, the wall portion 311 and the wall portion 312 have a second width W2 that is longer than the first width W1 in the width direction WD in a state in which the insertion portion 310 is not inserted into the insertion groove 82*e*. As illustrated in FIG. 7, the wall portion 311 and the wall portion 312 are disposed to be in contact with the insertion groove 82*e* such that the wall portion 311 and the wall portion 312 have the first width W1 in the width direction WD in a state in which the insertion portion 310 is inserted into the insertion groove 82*e*. The operator pinches the arm portion 321 and the arm portion 322 with finger tips, narrows the wall portion 311 and the wall portion 312 to have an interval that is shorter than the first width W1 in the width direction WD, and inserts the tube holding member 300 into the insertion groove 82*e*.

As illustrated in FIGS. 6 and 7, projecting portions 314 that project toward the tube 200 and extend along the depth direction DD that perpendicularly intersects the axial direction AD are formed in a surface of the wall portion 311 that comes into contact with the tube 200. Projecting portions 315 that project toward the tube 200 and extend in a direction that perpendicularly intersects the axial direction AD are formed in a surface of the wall portion 312 that comes into contact with the tube 200.

As illustrated in FIG. 8, the projecting portions 314 are formed in the wall portion 311 to extend along the depth direction DD that perpendicularly intersects the axial direction AD and are disposed at two locations with an interval therebetween along the axial direction AD. Although not illustrated, the projecting portions 315 are also formed in the wall portion 312 to extend along the depth direction DD that perpendicularly intersects the axial direction AD and are disposed at two locations with an interval therebetween along the axial direction AD.

As illustrated in FIG. 8, the projecting portions 314 have a length that is equal to or greater than an outer diameter Do of the tube 200 from the arm portion 321 toward the lower side of the wall portion 311. Although not illustrated, the projecting portions 315 also have a length that is equal to or greater than the outer diameter Do of the tube 200 from the arm portion 322 toward the lower side of the wall portion 312.

Therefore, the projecting portions 314 and the projecting portions 315 are caused to abut on the outer circumferential surface of the tube 200 when the operator inserts the tube 200 between the wall portion 311 and the wall portion 312 from the upper side of the arm portion 321 and the arm portion 322. The tube 200 is thus prevented from moving along the axial direction AD relative to the tube holding member 300.

Also, the projecting portions 314 and the projecting portions 315 are caused to strongly abut on the outer circumferential surface of the tube 200 even in a state in which the tube 200 is attached to the tube holding member 300. It is thus possible to hold the tube 200 held in a state in which the tube 200 is pinched between the wall portion 311 and the wall portion 312 such that the tube 200 does not move along the axial direction AD.

The arm portion 321 and the arm portion 322 are portions that the operator pinches with finger tips when the operator inserts the tube holding member 300 into the insertion groove 82*e*. A distal end portion 321*a* of the arm portion 321 is formed into a shape projecting outward (the side away from the tube 200) in the width direction WD. A distal end portion 322*a* of the arm portion 322 is formed into a shape projecting outward in the width direction WD. The operator can easily operate the tube holding member 300 by pinching the distal end portion 321*a* and the distal end portion 322*a* with two fingers.

As illustrated in FIG. 7, the length from an end portion of the distal end portion 321*a* to an end portion of the distal end portion 322*a* along the width direction WD is a third width W3. The length of the third width W3 along the width direction WD is preferably longer than the first width W1 of the insertion groove 82*e* in a state in which the tube 200 and the tube holding member 300 have been attached to the accommodating portion.

The length from the end portion of the distal end portion 321*a* to the end portion of the distal end portion 322*a* along the width direction WD is still longer than the first width W1 of the insertion groove 82*e* even if the operator pinches the distal end portion 321*a* and the distal end portion 322*a* with the two fingers, by setting the third width W3 to be longer than the first width W1. It is thus possible to prevent the distal end portion 321*a* and the distal end portion 322*a* instead of the insertion portion 310 from being inserted into the insertion groove 82*e* due to an error operation of the operator.

As illustrated in FIG. 8, the length of the wall portion 311 in an axial direction AD is a second length L2. Similarly, the length of the wall portion 312 in the axial direction AD is also the second length L2. The second length L2 is slightly shorter than the first length L1. Therefore, the wall portion 311 and the wall portion 312 have a length in the axial direction AD with which the wall portion 311 and the wall portion 312 can be inserted into the insertion groove 82*e*.

As illustrated in FIG. 8, the length of the arm portion 321 in the axial direction AD is a third length L3. Similarly, the length of the arm portion 322 in the axial direction AD is also the third length L3. The third length L3 is shorter than the second length L2. Therefore, it is possible to form the arm portion 321 and the arm portion 322 to be smaller than the wall portion 311 and the wall portion 312 in the axial direction AD and thereby to reduce the tube holding member 300 in size.

Note that the length of the arm portion 321 in the axial direction AD may be a fourth length L4 that is longer than the first length L1 of the insertion groove 82*e* as illustrated by the dashed line in FIG. 8. In this case, the length of the arm portion 322 in the axial direction AD is also the fourth length L4. The fourth length of the arm portion 321 and the arm portion 322 in the axial direction AD is longer than the first length L1 of the insertion groove 82*e* in the axial direction AD. Therefore, it is possible to prevent the arm portion 321 and the arm portion 322 instead of the insertion portion 310 from being inserted into the insertion groove 82*e* due to an error operation of the operator.

As illustrated in FIG. 5, the display portion 321*b* that displays identification information for identifying the tube 200 held by the wall portion 311 and the wall portion 312 is provided at the distal end portion 321*a* of the arm portion 321. At the display portion 321*b* illustrated in FIG. 5, identification information "80" indicating that the inner diameter Di (see FIG. 8) of the tube 200 is 0.80 mm is displayed.

The display portion 321*b* displays the identification information with a paint or the like with a color different from that of the other part, for example. Also, the display portion 321*b* may be molded into a shape indicating the identification information. Moreover, the display portion 321*b* may be an attached sticker or the like on which the identification information has been printed. Also, the identification information displayed at the display portion 321*b* may be other information that is different from the information indicating the inner diameter Di of the tube 200.

For example, the identification information may be a character code associated with the inner diameter Di of the tube 200, information indicating the outer diameter Do of the tube 200, a character code associated with the outer diameter Do of the tube 200, information indicating the material of the tube 200, information for identifying one of the pair of tube holding members 300 from the other, or information obtained by combining such information. Also, the resin material forming the tube holding members 300 may be colored with a desired color corresponding to the tube 200 instead of the display portion 321*b* being provided.

Here, an operation that the operator performs when a state in which the tube 200 and the tube holding member 300 have not been attached to the accommodating portion 82 as illustrated in FIG. 6 is changed into a state in which the tube 200 and the tube holding member 300 have been attached to the accommodating portion 82 will be described.

The operator grips the tube holding member 300 with no tube 200 attached thereto and inserts the tube 200 between the wall portion 311 and the wall portion 312 from an upper side of the arm portion 321 and the arm portion 322. The operator inserts the tube 200 up to a position at which the tube 200 comes into contact with the inner circumferential surface of the coupling portion 313.

Next, the operator grips another tube holding member 300 with no tube 200 attached thereto and inserts the tube 200 between the wall portion 311 and the wall portion 312 from the upper side of the arm portion 321 and the arm portion 322. The operator inserts the tube 200 up to a position at which the tube 200 comes into contact with the inner circumferential surface of the coupling portion 313. The operator performs adjustment such that a disposition interval between the pair of tube holding members 300 becomes a predefined interval suitable for the tube pump 100 when the operator attaches the other (second) tube holding member 300 to the tube 200.

Next, the operator pinches the distal end portion 321*a* and the distal end portion 322*a* of one of the tube holding members 300 with finger tips in the state as illustrated in FIG. 6 and applies an external force in a direction of narrowing the interval between the wall portion 311 and the wall portion 312 in the width direction. Then, the coupling portion 313 is elastically deformed to shorten the length thereof in the width direction WD, and the length between the wall portion 311 and the wall portion 312 in the width direction WD becomes shorter than the first width W1 of the insertion groove 82*e*.

Next, the operator inserts the insertion portion 310 up to the bottom portion 82*f* of the insertion groove 82*e* while maintaining the state in which the length between the wall portion 311 and the wall portion 312 in the width direction WD is shorter than the first width W1 of the insertion groove 82*e*. Thereafter, the operator releases the state in which the operator pinches the distal end portion 321*a* and the distal end portion 322*a* of the one of the tube holding members 300 with the finger tips.

If the operator releases the state in which the operator pinches the distal end portion 321*a* and the distal end portion 322*a* with the finger tips, then a part of the elastic deformation of the coupling portion 313 is released, the length between the wall portion 311 and the wall portion 312 in the width direction WD is widened up to the first width W1 of the insertion groove 82*e*, and each of the wall portion 311 and the wall portion 312 comes into contact with the insertion groove 82*e*. Since a part of the elastic deformation of the coupling portion 313 is held without being released, the insertion portion 310 is held in the insertion groove 82*e* due to the elastic force of the coupling portion 313. It is thus possible to reliably maintain the state in which the tube 200 is held in the insertion groove 82*e* by the tube holding member 300.

Also, the operator similarly performs, on the other tube holding member 300 as well, an operation similar to the operation performed on the one of the tube holding member 300. In this manner, the tube holding members 300 are respectively attached to a pair of insertion grooves 82*e* formed in the accommodating portion 82.

Figure 9:
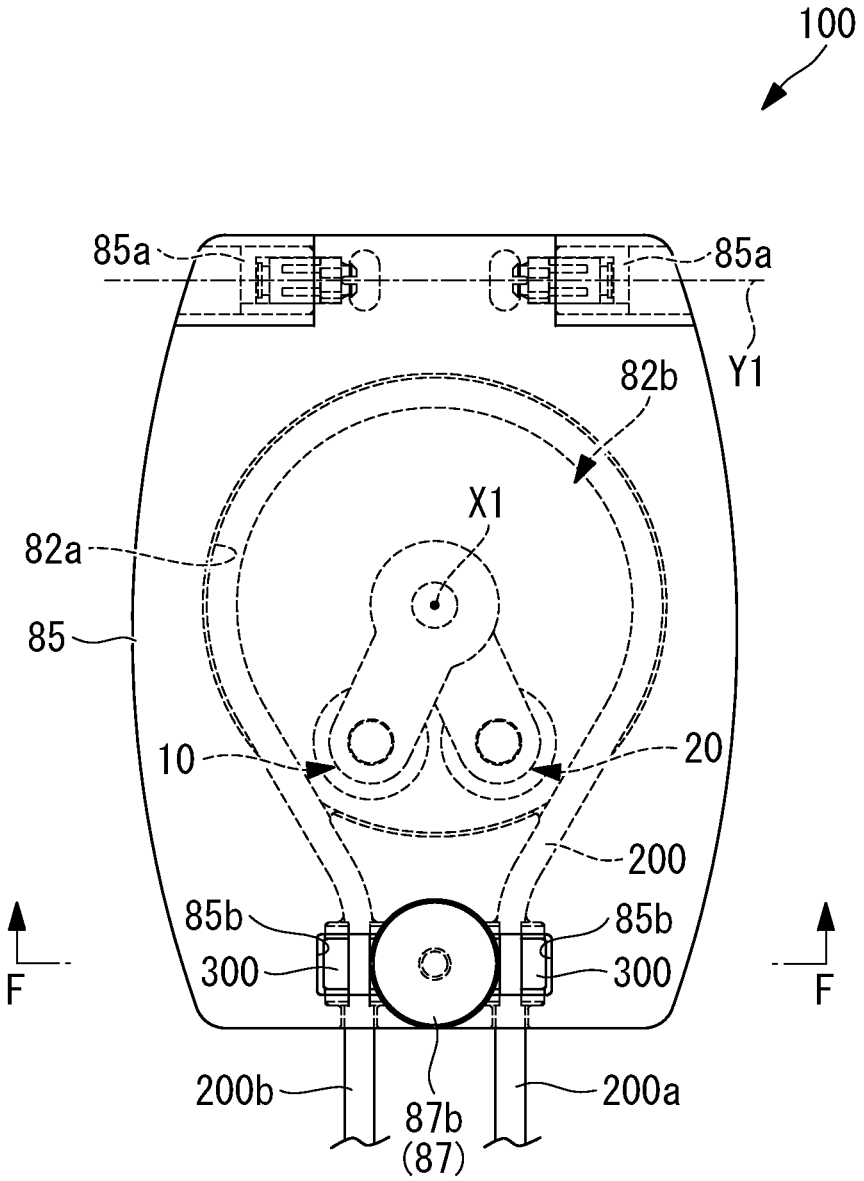
FIG. 9 is a plan view illustrating an embodiment of the tube pump with the lid portion in a closed state.
Figure 10:
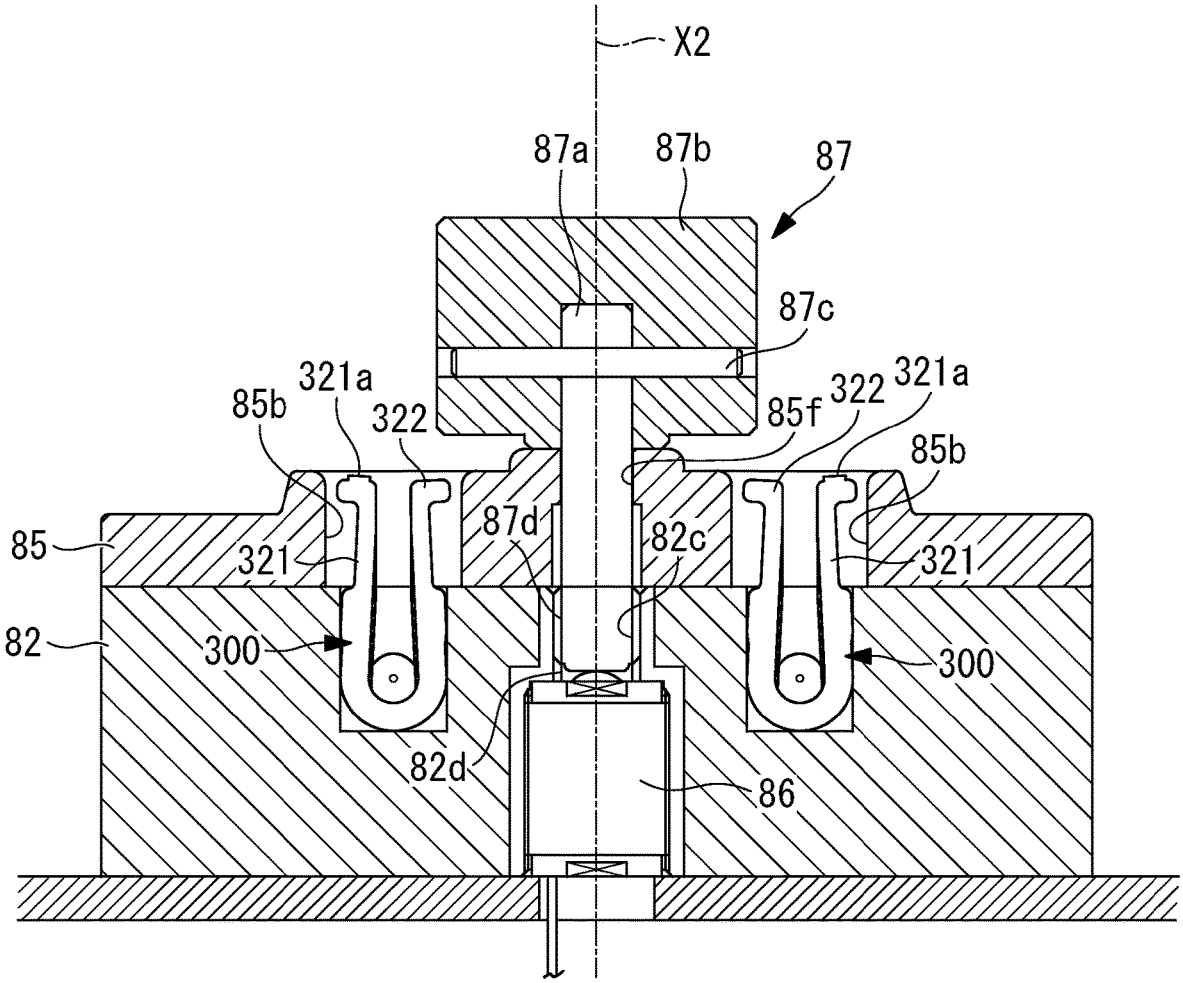
FIG. 10 is a sectional view of the arrows F-F in FIG. 9.

Next, the lid portion 85, an opening/closing detection sensor 86, and a locking mechanism 87 included in the tube pump 100 according to the present embodiment will be described with reference to the drawings. FIG. 9 is a plan view illustrating an embodiment of the tube pump 100 with the lid portion 85 in a closed state. FIG. 10 is a sectional view of the arrows F-F in FIG. 9.

The lid portion 85 is a member that can be switched between a closed state in which the lid portion 85 covers the entire region of the recessed portion 82*b* of the accommodating portion 82 and an opened state in which the lid portion 85 is separated from the recessed portion 82*b*. The lid portion 85 includes coupling portions 85*a* that are coupled to the accommodating portion 82. As illustrated in FIG. 9, the lid portion 85 is coupled to the accommodating portion 82 with a pair of coupling portions 85*a*. The lid portion 85 can swing around an axial line Y1 on which the pair of coupling portions 85*a* are disposed. The operator causes the lid portion 85 to swing around the axial line Y1 and switches the lid portion 85 to the opened state by gripping and lifting up a knob portion 87*b* of the locking mechanism 87.

As illustrated in FIGS. 9 and 10, a pair of through-holes 85*b* that accommodate the arm portions 321 and the arm portions 322 of the pair of tube holding members 300 in the closed state are formed in the lid portion 85. Therefore, the operator can recognize identification information for identifying the tube 200 displayed at display portions 321*b* provided at the distal end portions 321*a* of the arm portions 321 in the closed state.

As illustrated in FIG. 10, a state in which the distal end portions 321*a* and the distal end portions 322*a* of the tube holding members 300 are accommodated in the pair of through-holes 85*b* is achieved in the closed state in which the lid portion 85 has approached the accommodating portion 82. Therefore, the operator cannot pinch the distal end portions 321*a* and the distal end portions 322*a* of the tube holding members 300 in the closed state. The operator is thus prevented from performing an error operation of detaching the tube holding members 300 from the accommodating portion 82 in the closed state.

As illustrated in FIG. 10, the tube pump 100 according to the present embodiment includes the opening/closing detection sensor (detection portion) 86 that detects opened/closed states of the lid portion 85 and the locking mechanism 87 attached to the lid portion 85.

The locking mechanism 87 is a mechanism that fixes the lid portion 85 relative to the accommodating portion 82 such that the closed state is maintained. The locking mechanism 87 includes a shaft portion 87*a* extending along the axial line X2, a knob portion 87*b* attached to one end of the shaft portion 87*a*, and a stopper pin 87*c* that fixes the knob portion 87*b* to prevent the knob portion 87*b* from rotating about the axial line X2 relative to the shaft portion 87*a*.

An end portion of the shaft portion 87*a* on the side of the lid portion 85 is inserted into a through-hole 85*f* formed in the lid portion 85. A male screw portion 87*d* is formed at an end portion of the shaft portion 87*a* on the side of the lid portion 85. The male screw portion 87*d* rotates about the axial line X2 by the operator causing the knob portion 87*b* to rotate about the axial line X2.

As illustrated in FIG. 10, the opening/closing detection sensor 86 is provided at the accommodating portion 82, and a through-hole 82*c* is formed from the opening/closing detection sensor 86 toward the surface of the accommodating portion 82. A female screw portion 82*d* is formed in the inner circumferential surface of the through-hole 82*c*.

The operator can cause the lid portion 85 to swing around the axial line Y1 and achieve the closed state in which the lid portion 85 has approached the accommodating portion 82 as illustrated in FIG. 10 by gripping and lowering downward the lid portion 85 illustrated in FIG. 3. The operator causes the shaft portion 87*a* to rotate about the axial line X2 and causes the male screw portion 87*d* to be engaged with the female screw portion 82*d* by causing the knob portion 87*b* to rotate about the axial line X2 in the closed state. The lid portion 85 is fixed to the accommodating portion 82 to maintain the closed state by the male screw portion 87*d* being engaged with the female screw portion 82*d*.

The operator brings the distal end of the shaft portion 87*a* into contact with the opening/closing detection sensor 86 by causing the knob portion 87*b* to further rotate about the axial line X2 in the state in which the lid portion 85 is fixed to the accommodating portion 82. The opening/closing detection sensor 86 is turned into an ON state and detects that the lid portion 85 is in the closed state if the distal end of the shaft portion 87*a* comes into contact therewith. The opening/closing detection sensor 86 is turned into an OFF state and detects that the lid portion 85 is in the opened state in a case in which the distal end of the shaft portion 87*a* does not come into contact therewith.

The tube pump 100 according to the present embodiment can execute an ejection control mode (first control mode) in which the first roller portion 10 and the second roller portion 20 are caused to rotate in the same direction to eject a liquid in the tube 200 using the first roller portion 10 and the second roller portion 20, by a control unit (not illustrated) controlling the first drive unit 50 and the second drive unit 60.

In a case in which the ejection control mode is executed, the operator sets the flow amount per unit time of the liquid that the tube pump 100 is caused to eject on the flow-out side 200*b* via an input unit (not illustrated). The control unit (not illustrated) controls the first drive unit 50 and the second drive unit 60 such that ejection of the set flow amount on the flow-out side 200*b* is achieved.

Also, the tube pump 100 according to the present embodiment can execute a tube replacement mode (second control mode) in which a rotation angle of each of the first roller portion 10 and the second roller portion 20 is fixed to prevent the first roller portion 10 and the second roller portion 20 from coming into contact with the tube 200, by the control unit (not illustrated) controlling the first drive unit 50 and the second drive unit 60.

In a case in which the tube replacement mode is executed, the operator provides an instruction for executing the tube replacement mode via the input unit (not illustrated). The control unit (not illustrated) fixes the rotation angle of each of the first roller portion 10 and the second roller portion 20 to prevent the first roller portion 10 and the second roller portion 20 from coming into contact with the tube 200 as illustrated in FIG. 3.

Actions and effects achieved by the present embodiment described above will be described.

According to the tube holding member 300 in the present embodiment, the pair of wall portions 311 and 312 included in the insertion portion 310 have the second width W2 that is longer than the first width W1 of the insertion groove 82*e* in the width direction WD in a state in which the insertion portion 310 is not inserted into the insertion groove 82*e*. The operator pinches, with finger tips, the pair of arm portions 321 and 322 coupled to the pair of wall portions 311 and 312 held in a state in which the tube 200 is pinched and applies an external force in a direction of narrowing the interval between the pair of wall portions 311 and 312 in the width direction WD. Then, the coupling portion 313 is elastically deformed, and the length between the pair of wall portions 311 and 312 in the width direction WD becomes shorter than the first width W1 of the insertion groove 82*e*. The operator can insert the insertion portion 310 up to the bottom portion 82*f* of the insertion groove 82*e* by maintaining the state in which the length between the pair of wall portions 311 and 312 in the width direction WD is shorter than the first width W1.

If the operator releases the state in which the operator pinches the pair of arm portions 321 and 322 with the finger tips, then a part of the elastic deformation of the coupling portion 313 is released, the length between the pair of wall portions 311 and 312 in the width direction WD is widened up to the first width W1 of the insertion groove 82*e*, and each of the pair of wall portions 311 and 312 comes into contact with the insertion groove 82*e*. Since a part of the elastic deformation of the coupling portion 313 is held without being released, the insertion portion 310 is held in the insertion groove 82*e* due to the elastic force of the coupling portion 313. Therefore, it is possible to reliably maintain the state in which the tube 200 is held in the insertion groove 82*e* by the tube holding member 300.

Also, when the operator detaches the tube 200 from the insertion groove 82*e*, the operator pinches, with finger tips, the pair of arm portions 321 and 322 of the insertion portion 310 of the tube holding member 300 held in the insertion groove 82*e*. If the operator applies an external force in a direction of narrowing the interval between the pair of wall portions 311 and 312 in the width direction WD, then the coupling portion 313 is elastically deformed, and the length between the pair of wall portions 311 and 312 in the width direction WD becomes shorter than the first width W1 of the insertion groove 82*e*. The operator can easily pull out the insertion portion 310 from the insertion groove 82*e* by maintaining the state in which the length between the pair of wall portions 311 and 312 in the width direction WD is shorter than the first width W1. It is thus possible to easily perform the operation of detaching the tube 200 from the insertion groove 82*e* by the tube holding member 300.

According to the tube holding member 300 in the present embodiment, projecting portions 314 and 315 extending in a direction that perpendicularly intersects the axial direction AD are formed in the surfaces of the pair of wall portions 311 and 312 that come into contact with the tube 200. Since the projecting portions 314 and 315 are caused to strongly abut on the outer circumferential surface of the tube 200, it is possible to hold the tube 200 that is held in a state in which the tube 200 is pinched between the pair of wall portions 311 and 312 to prevent the tube 200 from moving in the axial direction AD.

According to the tube holding member 300 in the present embodiment, the display portion 321*b* that displays the identification information for identifying the tube 200 is provided at the distal end portion 321*a* of the arm portion 321 projecting from the insertion groove 82*e*, and it is thus possible for the operator to easily identify the tube 200 to be held in the insertion groove 82*e*.

According to the tube holding member 300 in the present embodiment, the distal ends of the pair of arm portions 321 and 322 project outward in the width direction WD, the operator can easily perform the operation of pinching the pair of arm portions 321 and 322 with finger tips and applying an external force in the direction of narrowing the interval between the pair of wall portions 311 and 312 in the width direction WD.

According to the tube pump 100 in the present embodiment, the arm portions 321 and 322 of the pair of tube holding members 300 and the pair of through-holes 85*b* that accommodates the arm portions 321 and 322 in the closed state are formed in the lid portion 85. Therefore, the operator can easily recognize the identification information for identifying the tube 200 that is displayed at the display portions 321*b* at the distal end portions 321*a* of the arm portions 321 in the closed state.

Other Embodiments

In the above description, the tube pump 100 includes the tube holding member 300 that holds the tube 200 on the flow-in side 200*a* and is inserted into the insertion groove 82*e* and the tube holding member 300 that holds the tube 200 on the flow-out side 200*b* and is inserted into the insertion groove 82*e*. Also, the pair of tube holding members 300 are not coupled to each other. However, other aspects may also be employed.

Figure 11:
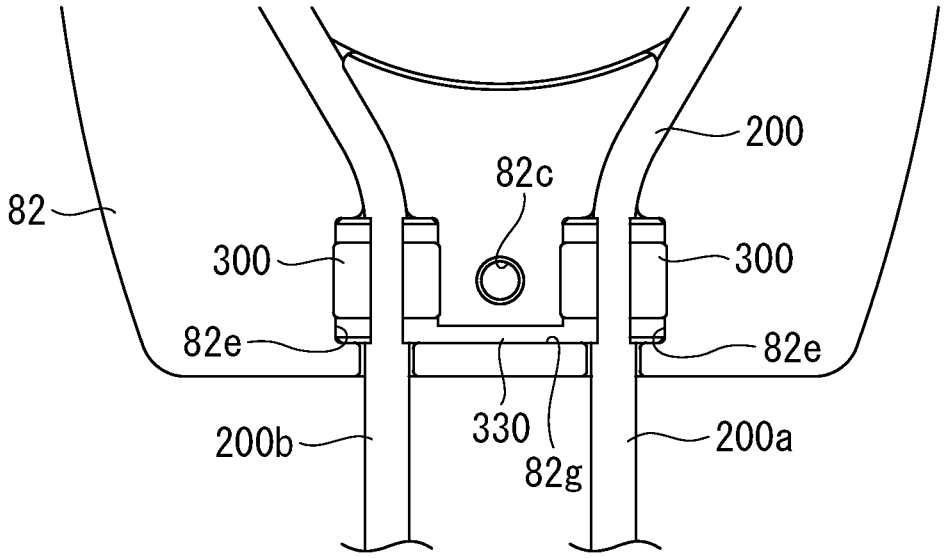
FIG. 11 is a partially enlarged view of the vicinity of an insertion groove of the tube pump.
Figure 12:
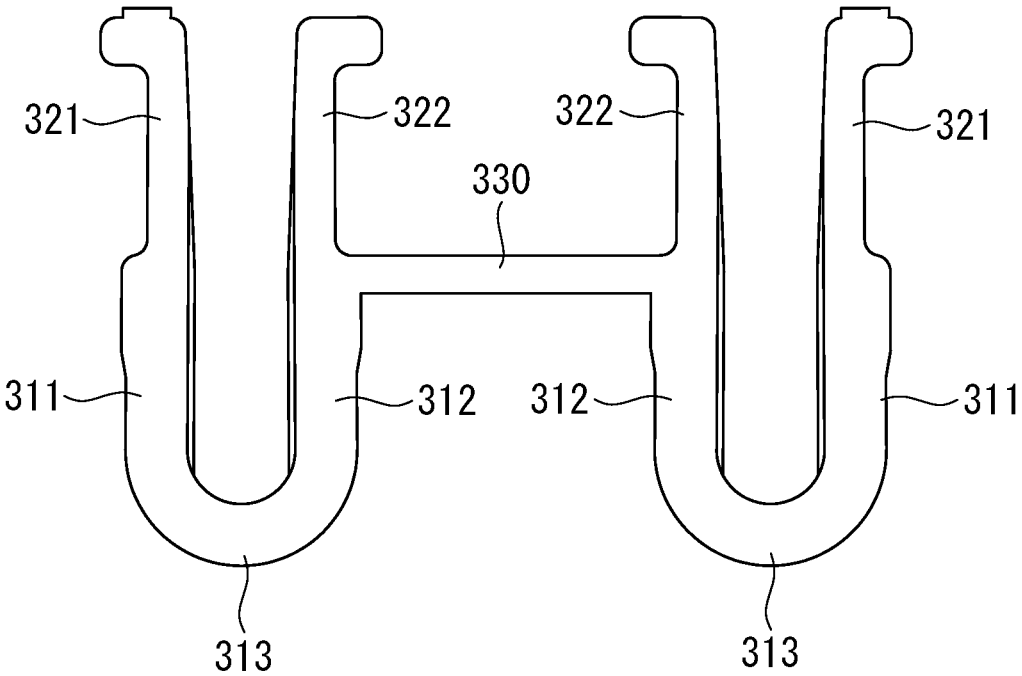
FIG. 12 is a diagram illustrating a pair of tube holding members coupled by a coupling portion.

For example, the pair of tube holding members 300 may be coupled to each other via a coupling portion 330. FIG. 11 is a partially enlarged view in the vicinity of the insertion groove 82*e* of the tube pump 100. FIG. 12 is a diagram illustrating the pair of tube holding members coupled by the coupling portion 330.

As illustrated in FIG. 11, the tube holding member 300 that holds the tube 200 in the flow-in side 200*a* and is inserted into the insertion groove 82*e* and the tube holding member 300 that holds the tube 200 on the flow-out side 200*b* and is inserted into the insertion groove 82*e* are coupled to each other by the coupling portion 330. As illustrated in FIG. 12, the coupling portion 330 couples the wall portion 312 of one of the tube holding members 300 to the wall portion 312 of the other tube holding member 300.

An accommodating groove 82*g* in which the coupling portion 330 is accommodated when the pair of tube holding members 300 are inserted into the pair of insertion grooves 82*e* is formed in the accommodating portion 82 of the casing 80. Since the coupling portion 330 is accommodated in the accommodating groove 82*g*, the coupling portion 330 does not project from the upper surface of the accommodating portion 82.

The coupling portion 330 has a length adjusted in advance such that one of the tube holding members 300 is inserted into one of the insertion grooves 82*e* and the other tube holding member 300 is inserted into the other insertion groove 82*e*. Therefore, the operator can, by positioning any one of the pair of tube holding members 300 in the insertion groove 82*e*, position the other one of the pair of tube holding members 300 in the insertion groove 82*e*. In this manner, the operator can easily perform the operation of inserting the pair of tube holding members 300 into the pair of insertion grooves 82*e*.

Also, the tube holding members 300 are attached to the accommodating portion 82 by accommodating the coupling portion 330 in the accommodating groove 82*g*. It is thus possible to uniquely define the insertion groove 82*e* into which one of the pair of tube holding members 300 is to be inserted and the insertion groove 82*e* into which the other one of the pair of the tube holding member 300 is to be inserted. Therefore, it is possible to prevent erroneous connection of attaching one of the pair of tube holding members 300 to the insertion groove 82*e* that does not correspond to the one of the pair of tube holding members 300. Also, since the relative positions of the pair of tube holding members 300 are fixed by the coupling portion 330, it is possible to prevent a state in which the relative positions are not fixed and the tube 200 is thus twisted.

While example embodiments have been particularly shown and described, it will be understood by those skilled in the art that various changes in form and details may be made therein without departing from the scope of the embodiments encompassed by the appended claims.

What is claimed is:

1. A tube holding member inserted into an insertion groove that extends along an axial direction and has a first width in a width direction that perpendicularly intersects the axial direction and holding a tube in the insertion groove along the axial direction, the tube holding member comprising:

an insertion portion that is inserted into the insertion groove in a state in which the tube is disposed along the axial direction; and a pair of arm portions that extend along the axial direction and project from the insertion groove in a state in which the insertion portion is inserted up to a bottom portion of the insertion groove, wherein the insertion portion includes a pair of wall portions that extend along the axial direction, are coupled to the pair of arm portions, and are disposed at an interval in the width direction such that the pair of wall portions hold the tube in a pinched state, and a coupling portion that extends along the axial direction, couples the pair of wall portions, and is disposed to face the bottom portion of the insertion groove, the coupling portion is elastically deformable to contract along the width direction by an operator pinching the pair of arm portions with finger tips and narrowing an interval therebetween in the width direction, and the pair of wall portions are disposed to be in contact with the insertion groove such that the pair of wall portions have a second width that is longer than the first width in the width direction in a state in which the insertion portion is not inserted into the insertion groove and have the first width in the width direction in a state in which the insertion portion is inserted into the insertion groove, wherein when the tube holding member is fully inserted into the insertion groove, the pair of arm portions extend beyond the insertion groove.

2. The tube holding member according to claim 1, wherein the insertion portion and the pair of arm portions are integrally molded using a resin material.

3. The tube holding member according to claim 1, wherein projecting portions projecting toward the tube and extending in a direction that perpendicularly intersects the axial direction are formed on surfaces of the pair of wall portions that come into contact with the tube.

4. The tube holding member according to claim 1, wherein display portions that display identification information for identifying the tube to be held by the pair of wall portions are provided at distal end portions of the arm portions.

5. The tube holding member according to claim 1, wherein the distal end portions of the pair of arm portions are formed into shapes projecting outward in the width direction.

6. A tube pump comprising:

an accommodating portion that has an inner circumferential surface, which is formed into an arc shape around a rotational axis, on which a tube with flexibility is disposed, and is opened to one end side along the rotational axis;

a plurality of roller portions that are accommodated in the accommodating portion and rotate about the rotational axis in a state in which the tube is blocked; and a drive unit that causes the plurality of roller portions to rotate about the rotational axis, wherein an insertion groove that extends along an axial direction and has a first width in a width direction that perpendicularly intersects the axial direction is formed in the accommodating portion, a tube holding member that holds the tube in the insertion groove along the axial direction is included, the tube holding member includes an insertion portion that is inserted into the insertion groove in a state in which the tube is disposed along the axial direction, and a pair of arm portions that extend along the axial direction and project from the insertion groove in a state in which the insertion portion is inserted up to a bottom portion of the insertion groove, the insertion portion includes a pair of wall portions that extend along the axial direction, are coupled to the pair of arm portions, and are disposed at an interval in the width direction such that the pair of wall portions hold the tube in a pinched state, and a coupling portion that extends along the axial direction, couples the pair of wall portions, and is disposed to face the bottom portion of the insertion groove, the coupling portion is elastically deformable to contract along the width direction by an operator pinching the pair of arm portions with finger tips and narrowing an interval therebetween in the width direction, and the pair of wall portions are disposed to be in contact with the insertion groove such that the pair of wall portions have a second width that is longer than the first width in the width direction in a state in which the insertion portion is not inserted into the insertion groove and have the first width in the width direction in a state in which the insertion portion is inserted into the insertion groove, wherein when the tube holding member is fully inserted into the insertion groove, the pair of arm portions extend beyond the insertion groove.

7. The tube pump according to claim 6, wherein the accommodating portion has a recessed portion that accommodates the plurality of roller portions, a lid portion that is able to be switched between a closed state in which the lid portion covers an entire region of the recessed portion and an opened state in which the lid portion is separated from the recessed portion is included, display portions that display identification information for identifying the tube to be held by the pair of wall portions are provided at distal end portions of the arm portions in the tube holding member, and a pair of through-holes that accommodate the pair of arm portions in the closed state are formed in the lid portion.

* * * * *